US006956189B1

(12) United States Patent
Verhagen

(10) Patent No.: US 6,956,189 B1
(45) Date of Patent: Oct. 18, 2005

(54) ALARM AND INDICATION SYSTEM FOR AN ON-SITE INDUCTION HEATING SYSTEM

(75) Inventor: Paul D. Verhagen, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 160 days.

(21) Appl. No.: 09/995,166

(22) Filed: Nov. 26, 2001

(51) Int. Cl.[7] ..... H05B 6/06; H05B 6/42

(52) U.S. Cl. ..... 219/632; 219/677; 219/668; 336/57; 336/62; 174/15.6

(58) Field of Search ..... 219/632, 677, 219/672, 676, 668, 667, 663; 336/57, 60, 336/62; 174/15.6, 15.1

(56) References Cited

U.S. PATENT DOCUMENTS

| | | | | |
|---|---|---|---|---|
| 2,457,843 A | | 1/1949 | Strickland, Jr. | 174/47 |
| 2,483,301 A | | 9/1949 | Roberds | 174/15 |
| 2,817,066 A | | 12/1957 | Scarpa | 336/84 |
| 2,988,804 A | | 6/1961 | Tibbetts | 29/155.57 |
| 3,022,368 A | | 2/1962 | Miller | 174/15 |
| 3,492,453 A | | 1/1970 | Hurst | 219/10.49 |
| 3,535,597 A | | 10/1970 | Kendrick | 317/155.5 |
| 3,705,285 A | * | 12/1972 | Cachat | 219/646 |
| 3,764,725 A | | 10/1973 | Kafka | 174/15 |
| 3,873,830 A | * | 3/1975 | Forster | 250/236 |
| 3,946,349 A | | 3/1976 | Haldeman, III | 336/62 |
| 4,317,979 A | | 3/1982 | Frank et al. | 219/10.77 |
| 4,339,645 A | | 7/1982 | Miller | 219/10.49 |
| 4,355,222 A | | 10/1982 | Geithman et al. | 219/10.57 |
| 4,392,040 A | | 7/1983 | Rand et al. | 219/10.71 |
| 4,456,807 A | * | 6/1984 | Ogino et al. | 219/626 |
| 4,527,032 A | | 7/1985 | Young et al. | 219/10.61 |
| 4,527,550 A | | 7/1985 | Ruggera et al. | 128/1.5 |
| 4,549,056 A | | 10/1985 | Okatsuka et al. | 219/10.77 |
| 4,578,552 A | | 3/1986 | Mortimer | 219/10.41 |
| 4,675,057 A | * | 6/1987 | Pfaffmann et al. | 148/509 |
| 4,761,528 A | | 8/1988 | Caillaut et al. | 219/10.491 |
| 4,794,220 A | | 12/1988 | Sekiya | 219/10.491 |
| 4,845,332 A | * | 7/1989 | Jancosek et al. | 219/645 |
| 4,900,885 A | | 2/1990 | Inumada | 219/10.55 B |
| 4,942,279 A | | 7/1990 | Ikeda | 219/10.75 |
| 4,963,694 A | | 10/1990 | Alexion et al. | 174/15.6 |
| 4,975,672 A | | 12/1990 | McLyman | 336/198 |

(Continued)

FOREIGN PATENT DOCUMENTS

JP 2000-192135 * 7/2000

OTHER PUBLICATIONS

Mannings U.S.A. Brochure—"Induction Bolt Heating Services".

(Continued)

*Primary Examiner*—Philip H. Leung
(74) *Attorney, Agent, or Firm*—Fletcher Yoder

(57) ABSTRACT

An induction heating system having a fluid cooling unit, a power source, an induction heating device, a controller, and an alarm system to place the system in a safe condition when an improper operating condition is detected. The induction heating system may have a flow switch to detect fluid flow through the system. The system may operate to secure power to the induction heating device when cooling flow is inadequate. Alternatively, the system may increase fluid flow to provide adequate cooling flow. The controller may have a visual indicator of inadequate flow or an improper power source operating condition.

35 Claims, 8 Drawing Sheets

U.S. PATENT DOCUMENTS

| | | | | |
|---|---|---|---|---|
| 5,004,865 | A | 4/1991 | Krupnicki | 174/15.7 |
| 5,101,086 | A | 3/1992 | Dion et al. | 219/10.491 |
| 5,113,049 | A | 5/1992 | Border et al. | 219/10.79 |
| 5,185,513 | A | 2/1993 | Pacileo | 219/497 |
| 5,313,037 | A | 5/1994 | Hansen et al. | 219/632 |
| 5,343,023 | A | 8/1994 | Geissler | 219/661 |
| 5,461,215 | A | 10/1995 | Haldeman | 219/677 |
| 5,504,309 | A | 4/1996 | Geissler | 219/663 |
| 5,708,253 | A | 1/1998 | Bloch et al. | 219/130.01 |
| 6,043,471 | A | 3/2000 | Wiseman et al. | 219/662 |
| 6,124,581 | A | 9/2000 | Ulrich | 219/665 |
| 6,229,126 | B1 * | 5/2001 | Ulrich et al. | 219/635 |
| 6,265,701 | B1 | 7/2001 | Bickel et al. | 219/617 |
| 6,288,643 | B1 * | 9/2001 | Lerg et al. | 340/540 |
| 6,316,755 | B1 | 11/2001 | Ulrich | 219/665 |
| 6,346,690 | B1 | 2/2002 | Ulrich et al. | 219/635 |

OTHER PUBLICATIONS

Superheat Services, Inc. Brochure—"On Site Heat Treatment Specialists".

400 Cycle Induction Heating with proportional control for Preheating and Stress Relieving or Welding Joints, Hobart Brothers Co.

Installation, Operation, and Maintenance for High Frequency Induction Heaters, Hobart Brothers Co.

* cited by examiner

ALARM AND INDICATION SYSTEM FOR AN ON-SITE INDUCTION HEATING SYSTEM

FIELD OF THE INVENTION

The present invention relates generally to induction heating, and particularly to an on-site induction heating system.

BACKGROUND OF THE INVENTION

Induction heating is a method of heating a workpiece. Induction heating involves applying an AC electric signal to a conductor adapted to produce a magnetic field, such as a loop or coil. The alternating current in the conductor produces a varying magnetic flux. The conductor is placed near a metallic object to be heated so that the magnetic field passes through the object. Electrical currents are induced in the metal by the magnetic flux. The metal is heated by the flow of electricity induced in the metal by the magnetic field.

Most previous induction heating systems have been large, fixed systems that are located in a foundry or other manufacturing facility. These induction heating systems may be used as part of a mass-production process. As such, dedicated operators may be available to operate and monitor these systems on a continuous basis. On the other hand, portable induction heating systems may be used in remote locations and may not have an operator present to monitor the operation of the system on a continuous basis.

There is a need for an induction heating system that may be used in remote locations and which responds automatically to protect the system when error conditions are detected by the system. Additionally, there is a need for an induction heating system that provides an alarm and/or indications to indicate the presence of an error condition.

SUMMARY OF THE INVENTION

The present technique provides novel inductive heating components, systems, and methods designed to respond to such needs. According to one aspect of the present technique, an induction heating system is provided that comprises a power source, a fluid cooling unit, an induction heating device, a controller, and a flow switch. The induction heating device is electrically coupled to the power source. In addition, the fluid cooling unit provides a flow of cooling fluid to the induction heating device. The controller controls the operation of the power source. The flow switch is electrically coupled to the controller and senses the flow of cooling fluid. The controller prevents the power source from supplying power to the induction heating device when the flow of cooling fluid through the flow switch is below a predefined amount.

According to another aspect of the present technique, a controller having a control circuit and a flow switch is featured. The control circuit is coupled to the power source. The flow switch is electrically coupled to the control circuit and is operable to sense the flow of cooling fluid. The control circuit prevents the power source from supplying power to the induction heating device when the flow of cooling fluid through the flow switch is below a predefined amount.

According to another aspect of the present technique, a portable induction heating system is featured that has a power source, an induction heating device that is electrically coupled to the power source, and a fluid cooling unit to provide a flow of cooling fluid to the induction heating device. The system also has a system controller that controls operation of the power source and has an alarm system. The alarm system has an indicator to provide an indication when a fault condition exists in the system.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
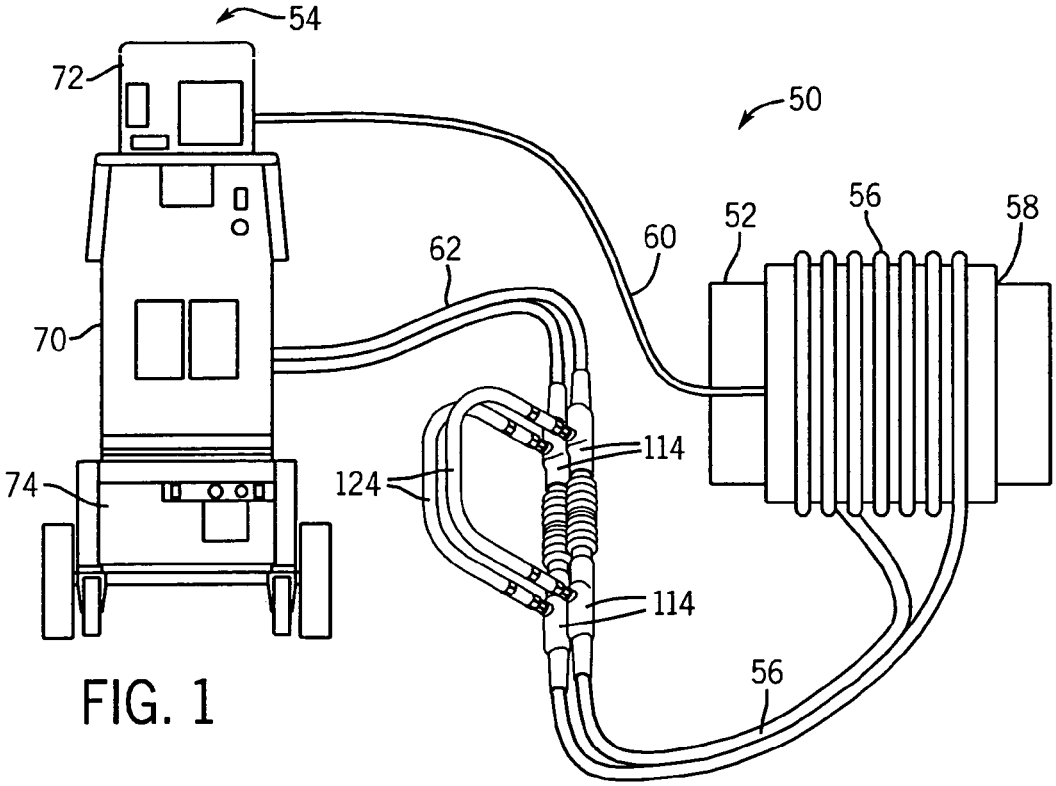
FIG. 1 is an induction heating system, according to an exemplary embodiment of the present technique.

Referring generally to FIGS. 1–5, an induction heating system 50 for applying heat to a workpiece 52 is illustrated. In the illustrated embodiment, the workpiece 52 is a circular pipe. However, the workpiece 52 may have a myriad of shapes and compositions. As best illustrated in FIG. 1, the induction heating system 50 comprises a power system 54, a flexible fluid-cooled induction heating cable 56, an insulation blanket 58, at least one temperature feedback device 60, and an extension cable 62. The extension cable 62 is used to extend the effective distance of the fluid-cooled induction heating cable 56 from the power system 54. The power system 54 produces a flow of AC current through the extension cable 62 and fluid-cooled induction heating cable 56. Additionally, the power system provides a flow of cooling fluid through the extension cable 62 and fluid-cooled induction heating cable 56. In FIG. 1, the fluid-cooled induction heating cable 56 has been wrapped around the workpiece 52 several times to form a series of loops.

Figure 2:
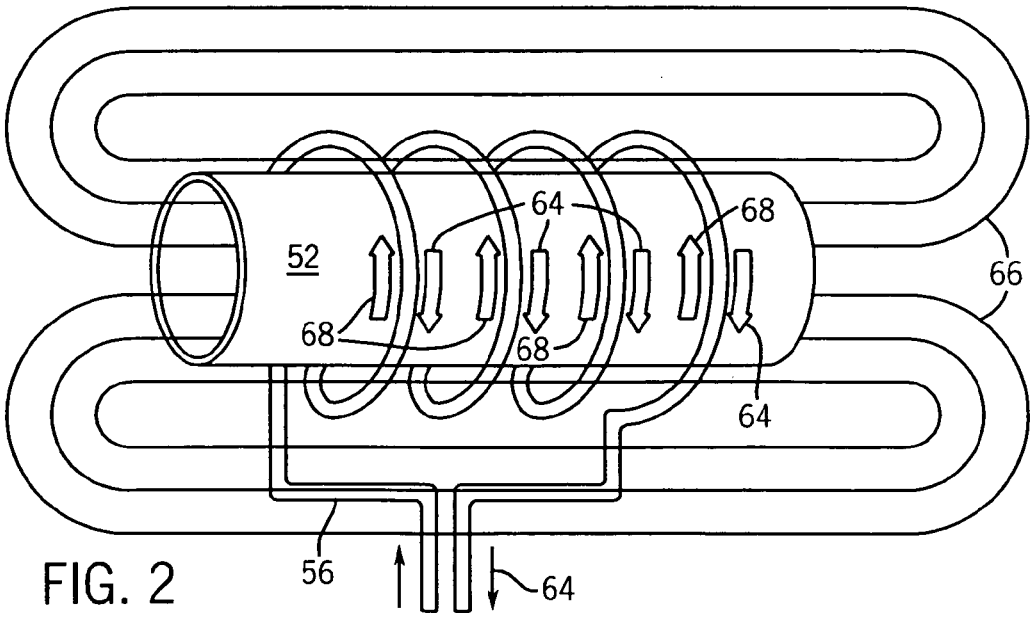
FIG. 2 is a diagram of the process of inducing heat in a workpiece using an induction heating system, according to an exemplary embodiment of the present technique.

As best illustrated in FIG. 2, the AC current 64 flowing through the fluid-cooled induction heating cable 56 produces a magnetic field 66. The magnetic field 66, in turn, induces a flow of current 68 in the workpiece 52. The induced current 68 produces heat in the workpiece 52. Referring again to FIG. 1, the insulation blanket 58 forms a barrier to reduce the loss of heat from the workpiece 52 and to protect the fluid-cooled induction heating cable 56 from heat damage. The fluid flowing through the fluid-cooled induction heating cable 56 also acts to protect the fluid-cooled induction heating cable 56 from heat damage due to the temperature of the workpiece 52 and electrical current flowing through the fluid-cooled induction heating cable. The temperature feedback device 60 provides the power system 54 with temperature information from the workpiece 52.

Referring again to FIG. 1, in the illustrated embodiment, the power system 54 comprises a power source 70, a controller 72, and a cooling unit 74. The power source 70 produces the AC current that flows through the fluid-cooled induction heating cable 56. In the illustrated embodiment, the controller 72 controls the operation of the power source 70 in response to programming instructions and the workpiece temperature information received from the temperature feedback device 60. The cooling unit 74 is operable to provide a flow of cooling fluid through the fluid-cooled induction heating cable 56 to remove heat from the fluid-cooled induction heating cable 56.

Figure 3:
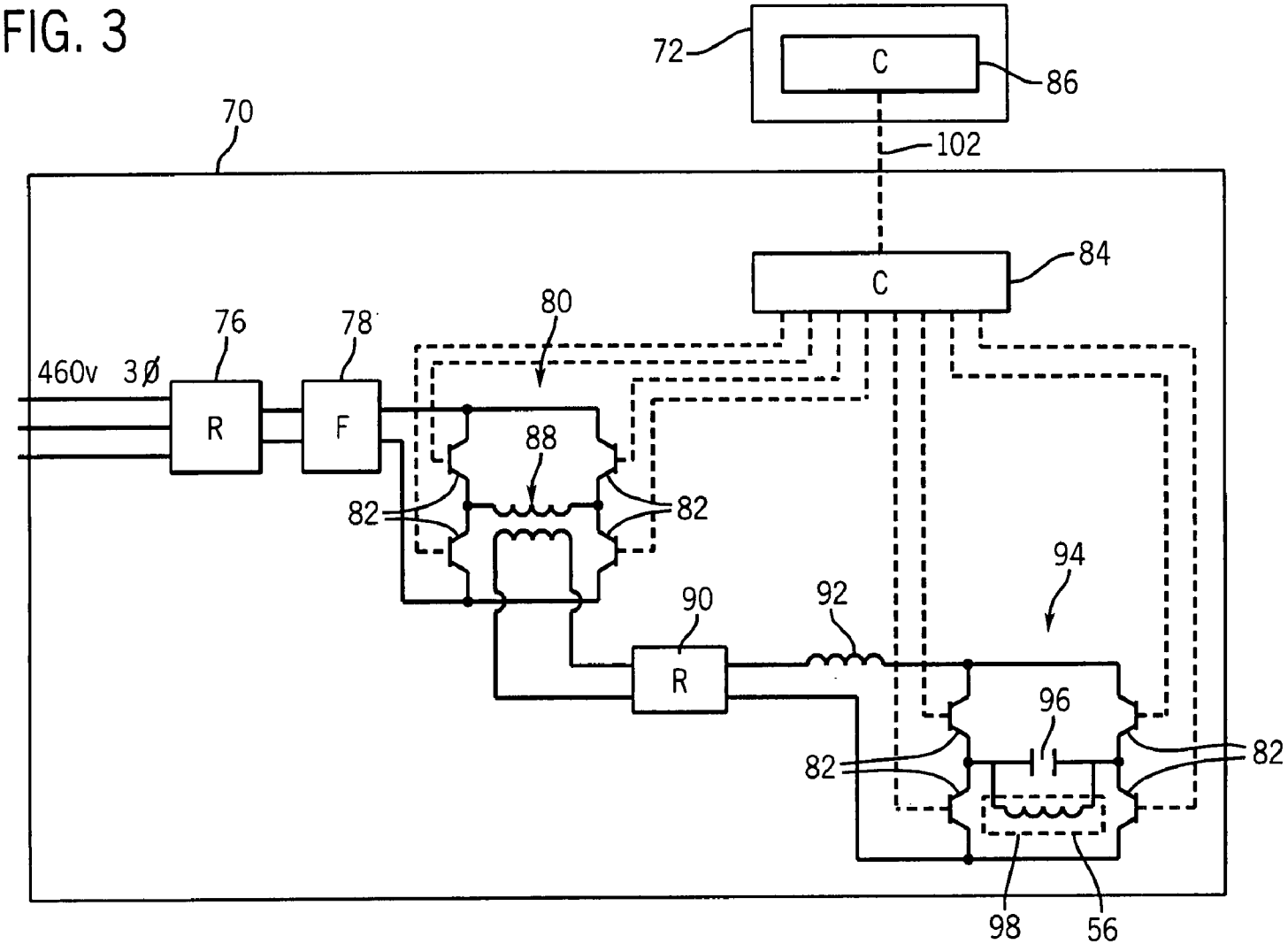
FIG. 3 is an electrical schematic diagram of an induction heating system, according to an exemplary embodiment of the present technique.

Referring generally to FIG. 3, an electrical schematic of a portion of the system 50 is illustrated. In the illustrated embodiment, 460 Volt, 3-phase AC input power is coupled to the power source 70. A rectifier 76 is used to convert the AC power into DC power. A filter 78 is used to condition the rectified DC power signals. A first inverter circuit 80 is used to invert the DC power into desired AC output power. In the illustrated embodiment, the first inverter circuit 80 comprises a plurality of electronic switches 82, such as IGBTs. Additionally, in the illustrated embodiment, a controller board 84 housed within the power source 70 controls the electronic switches 82. A controller board 86 within the controller 72 in turn, provides signals to control the controller board 84 in the power source 70.

A step-down transformer 88 is used to couple the AC output from the first inverter circuit 80 to a second rectifier circuit 90, where the AC is converted again to DC. In the illustrated embodiment, the DC output from the second rectifier 90 is, approximately, 600 Volts and 50 Amps. An inductor 92 is used to smooth the rectified DC output from the second rectifier 90. The output of the second rectifier 90 is coupled to a second inverter circuit 94. The second inverter circuit 94 steers the DC output current into high-frequency AC signals. A capacitor 96 is coupled in parallel with the fluid-cooled induction heating cable 56 across the output of the second inverter circuit 94. The fluid-cooled induction heating cable 56, represented schematically as an inductor 98, and capacitor 96 form a resonant tank circuit. The capacitance and inductance of the resonant tank circuit establishes the frequency of the AC current flowing through the fluid-cooled induction heating cable 56. The inductance of the fluid-cooled induction heating cable 56 is influenced by the number of turns of the heating cable 56 around the workpiece 52. The current flowing through the fluid-cooled induction heating cable 56 produces a magnetic field that induces current flow, and thus heat, in the workpiece 52.

Figure 4:
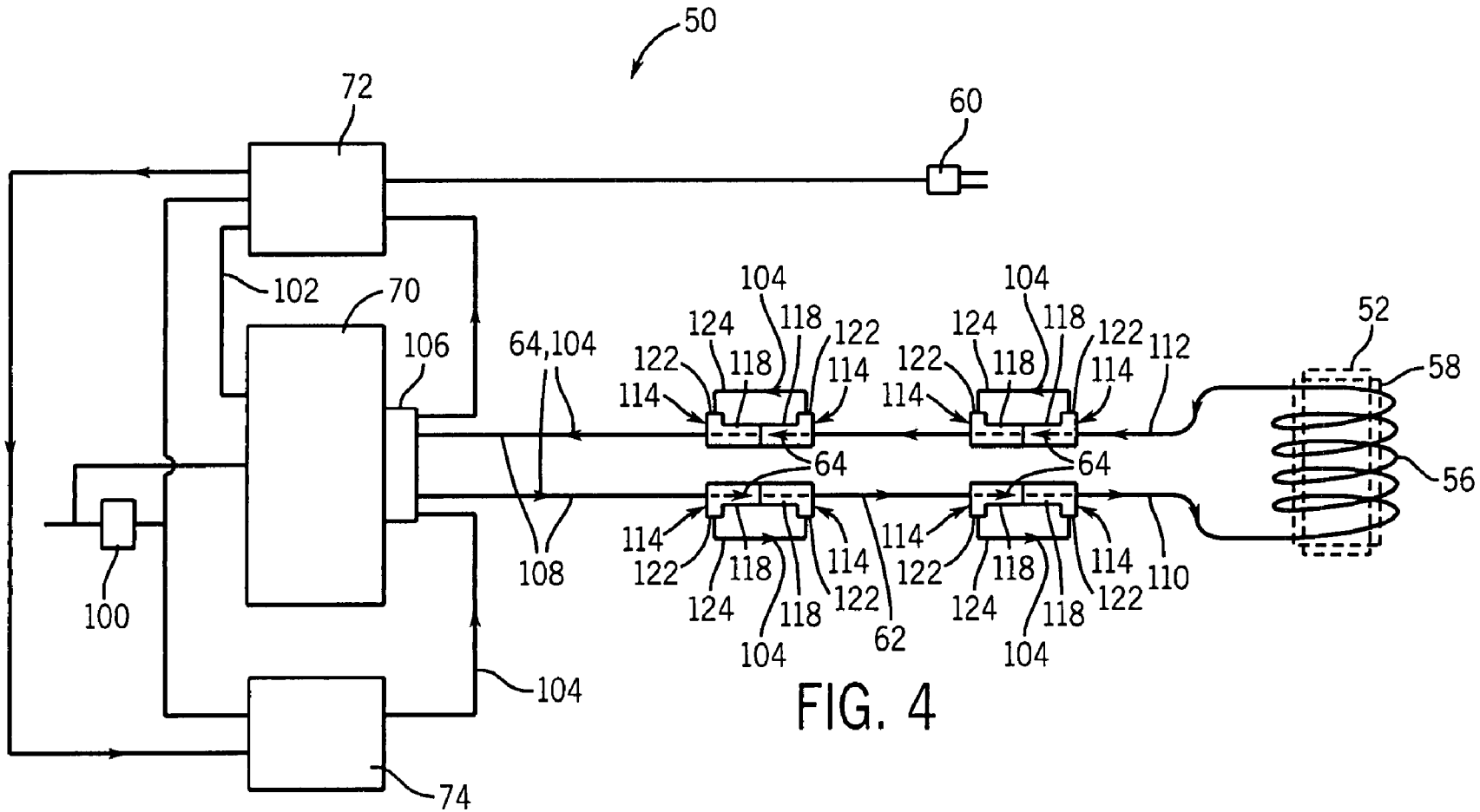
FIG. 4 is a schematic diagram of a system for inductively heating a workpiece, according to an exemplary embodiment of the present technique.

Referring generally to FIG. 4, an electrical and fluid schematic of the induction heating system 50 is illustrated. In the illustrated embodiment, 460 Volt, 3-phase AC input power is supplied to the power source 70 and to a step-down transformer 100. In the illustrated embodiment, the step-down transformer 100 produces a 115 Volt output applied to the fluid cooling unit 74 and to the controller 72. The step-down transformer 100 may be housed separately or within one of the other components of the system 50, such as the fluid cooling unit 74. A control cable 102 is used to electrically couple the controller 72 and the power source 70. As discussed above, the power source 70 provides a high-frequency AC power output, such as radio frequency AC signals, to the heating cable 56.

In the illustrated embodiment, cooling fluid 104 from the cooling unit 74 flows to an output block 106. The cooling fluid 104 may be water, anti-freeze, etc. Additionally, the cooling fluid 104 may be provided with an anti-fungal or anti-bacterial solution. In the illustrated embodiment, cooling fluid 104 flows from the output block 106 to the fluid-cooled induction heating cable 56 along a supply path 110 through the output cable 108 and the extension cable 62. The cooling fluid 104 returns to the output block 106 from the fluid-cooled induction heating cable 56 along a return path 112 through the extension cable 62 and the output cable 108. AC electric current 64 also flows along the supply and return paths. The AC electric current 64 produces a magnetic field that induces current, and thus heat, in the workpiece 52. Heat in the heating cable 56, produced either from the workpiece 52 or by the AC electrical current flowing through conductors in the heating cable 56, is carried away from the heating cable 56 by the cooling fluid 104. Additionally, the insulation blanket 58 forms a barrier to reduce the transfer of heat from the workpiece 52 to the heating cable 56.

Referring generally to FIGS. 1 and 4, the fluid-cooled induction heating cable 56 has a connector assembly 114 in the illustrated embodiment. Additionally, the extension cable 62 also has a pair of connector assemblies 114. Each connector assembly 114 is adapted for mating engagement with another connector assembly 114. In the illustrated embodiment, each connector assembly separately couples electricity and cooling fluid. The connector assemblies are electrically coupled by connecting an electrical connector 118 in one connector assembly 114 with an electrical connector 118 in a second connector assembly 114. Each of the connector assemblies 114 also has a hydraulic fitting 122. The connector assemblies 114 are fluidicly coupled by routing a jumper 124 from the hydraulic fitting 122 in one connector assembly 114 to the hydraulic fitting 122 in a second connector assembly 114. Electrical current 64 flows through the electrical connectors 118 and fluid 104 flows through the hydraulic fittings 122 and jumper 124. In the illustrated embodiment, cooling fluid 104 from the heating cable 56 is then coupled to the controller 72. Cooling fluid flows from the controller 72 back to the cooling unit 74. The cooling unit 74 removes heat in the cooling fluid 104 from the heating cable 56. The cooled cooling fluid 104 is then supplied again to the heating cable 56.

Figure 5:
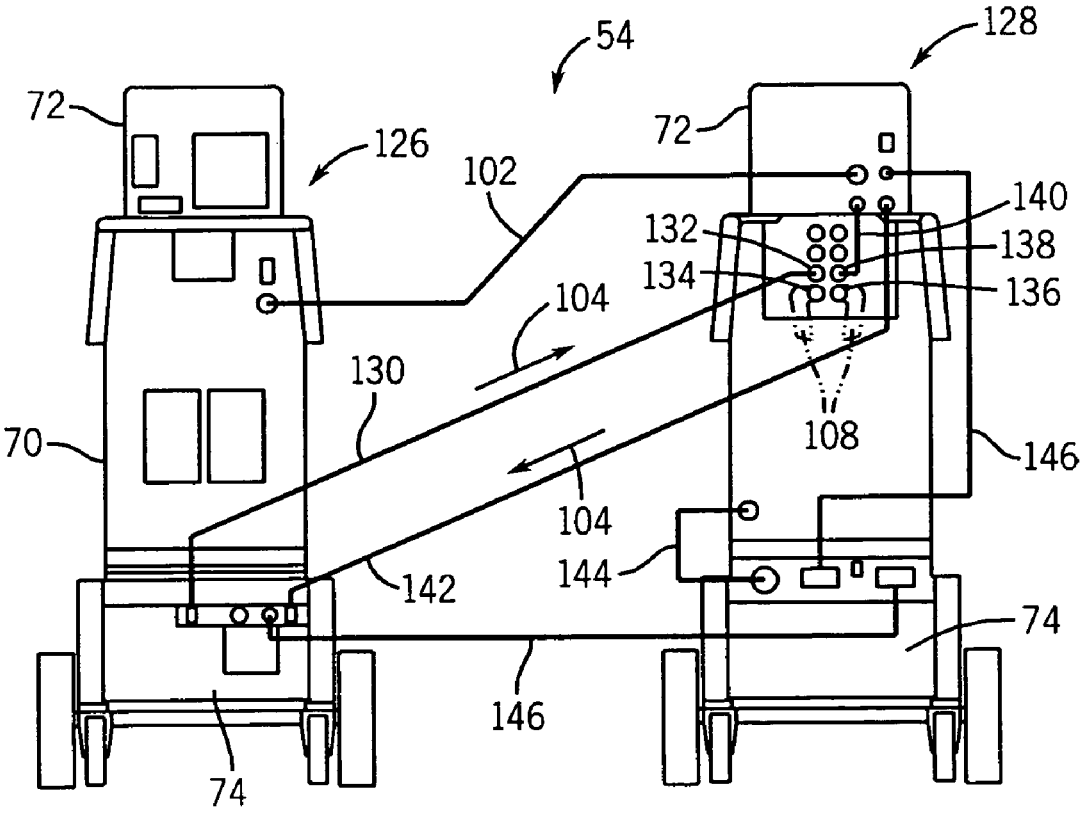
FIG. 5 is an elevational drawing illustrating the front and the rear of an induction heating system, according to an exemplary embodiment of the present technique.

FIG. 5 illustrates front and rear views of a power system 54. In the illustrated embodiment, the front side 126 of the power system 54 is shown on the left and the rear side 128 of the power system 54 is shown on the right. A first hose 130 is used to route fluid 104 from the front of the cooler 74 to a first terminal 132 of the output block 106 on the rear of the power source 70. The first terminal 132 is fluidicly coupled to a second terminal 134 of the output block 106. The output cable 108 is connected to the second terminal 134 and a third terminal 136. The second and third terminals are operable to couple both cooling fluid and electric current to the output cable 108. Supply fluid flows to the heating cable 56 through the second terminal 134 and returns from the heating cable 56 through the third terminal 136. The third terminal 136 is, in turn, fluidicly coupled to a fourth terminal 138. A second hose 140 is connected between the fourth terminal 138 and the controller 72. A third hose 142 is connected between the controller 72 and the cooling unit 74 to return the cooling fluid to the cooling unit 74, so that heat may be removed. An electrical jumper cable 144 is used to route 460 Volt, 3-phase power to the power source 70. Various electrical cables 146 are provided to couple 115 Volt power from the step-down transformer 100 to the controller 72 and the cooling unit 74.

Figure 6:
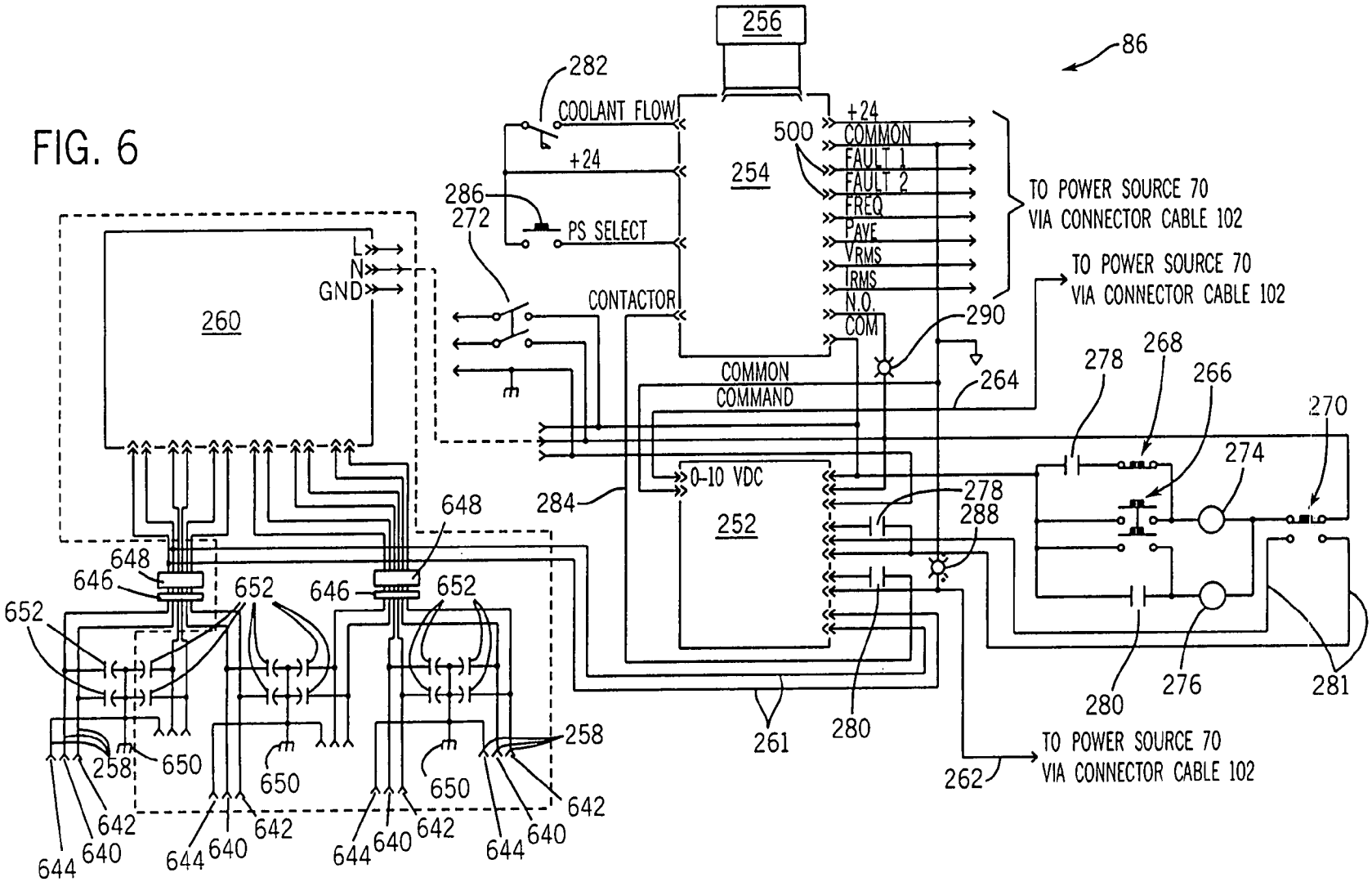
FIG. 6 is an electrical schematic of a controller, according to an exemplary embodiment of the present technique.
Figure 7:
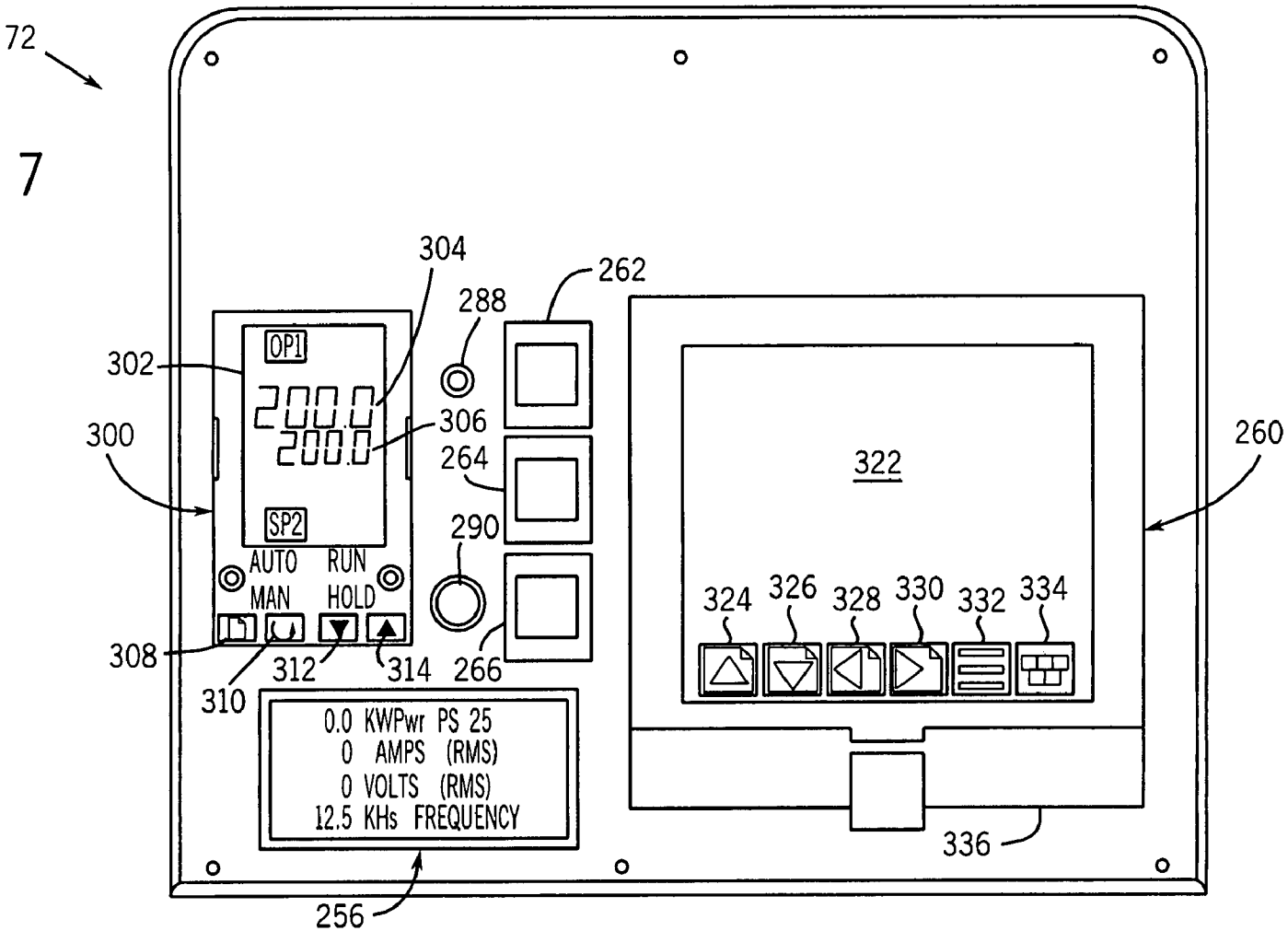
FIG. 7 is a front elevational view of a controller, according to an exemplary embodiment of the present technique.
Figure 8:
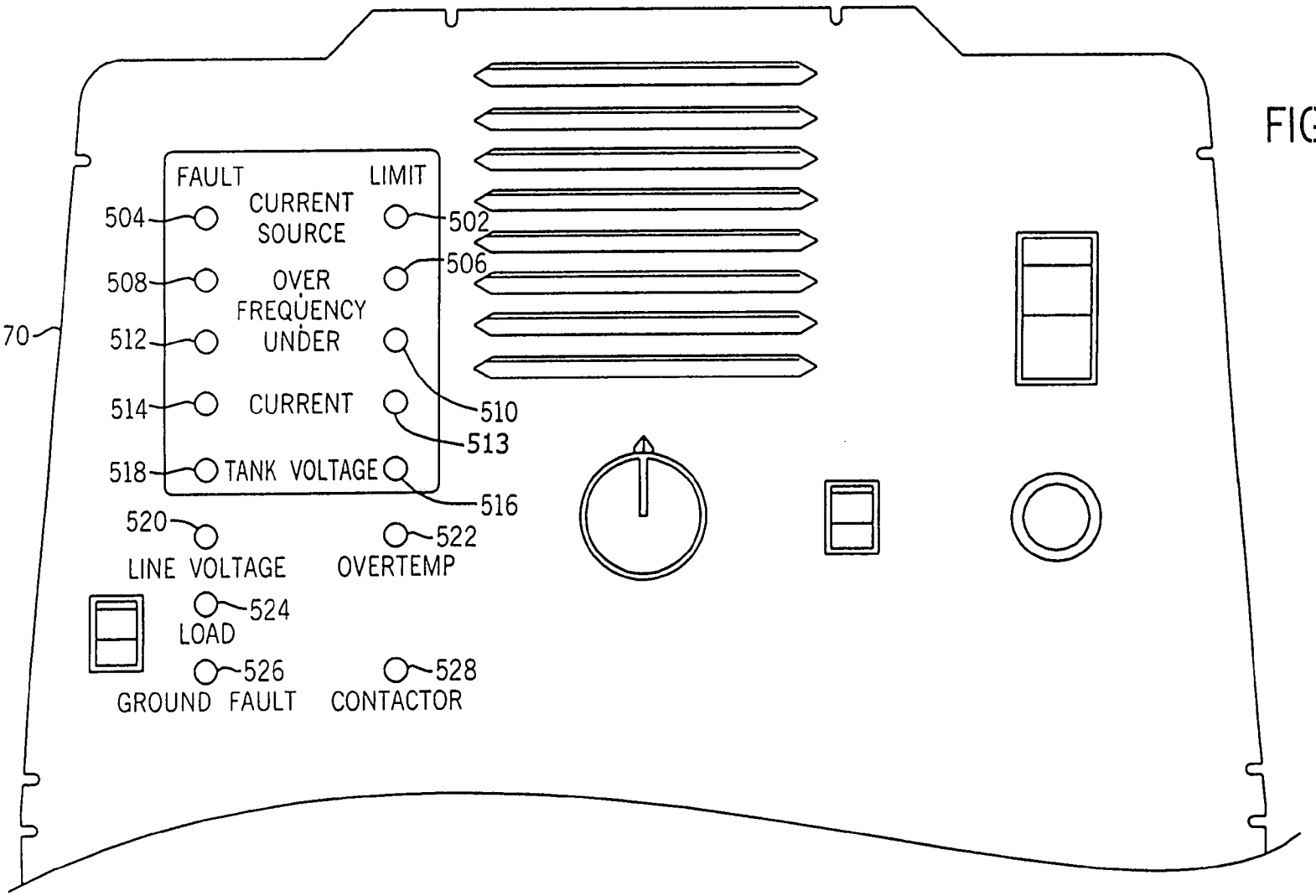
FIG. 8 is a front elevational view of a power source, according to an exemplary embodiment of the present technique.

Referring generally to FIGS. 6, 7 and 8, the controller 72 has control circuitry 86 that enables the system 50 to receive programming instructions and control the operation of the power source 70 in response to the programming instructions and data received from the power source 70 and temperature feedback device 60. In the illustrated embodiment, the control circuitry 86 comprises a control unit 252, an I/O unit 254, a parameter display 256, and a plurality of electrical switches. Connection jacks 258 are provided to enable the temperature feedback device 60 to be electrically coupled to the controller 72 and to a data recorder 260. At least one temperature feedback device 60 is coupled through the jacks 258 to the control unit 252 via a pair of conductors 261 so as to provide a DC voltage representative of temperature to the control unit 252. Additional jacks 258 are provided to enable a plurality of temperature feedback devices to be coupled to the data recorder 260. The data recorder 260 may be adapted to record operating parameters, as well. Preferably, the data recorder 260 is a digital device operable to store and transmit data electronically. Alternatively, the controller 72 may have a paper recorder, or no recorder at all.

The control unit 252 is operable to receive programming instructions to direct the system 50 to produce a desired temperature profile in a workpiece 52. During operation, the control unit 252 receives temperature data from a temperature feedback device 60 and controls the application of power to the workpiece 52 to achieve a desired workpiece temperature, a desired rate of temperature increase in the workpiece, etc. In addition, the control unit 252 is preprogrammed with operational control instructions that control how the control unit 252 responds to the programming instructions. Accordingly, the control unit 252 may comprise a processor and memory, such as RAM.

There are a number of control schemes that may be used to control the application of heat to the workpiece. For example, an on-off controller maintains a constant supply of power to the workpiece until the desired temperature is reached, then the controller turns off. However, this can result in temperature overshoots in which the workpiece is heated to much higher temperatures than is desired. In proportional control, the controller controls power in proportion to the temperature difference between the desired temperature and the actual temperature of the workpiece. A proportional controller will reduce power as the workpiece temperature approaches the desired temperature. The magnitude of a temperature overshoot is lessened with proportional control in comparison to an on-off controller. However, the time that it takes for the workpiece to achieve the desired temperature is increased. Other types of control schemes include proportional-integral (PI) control and proportional-derivative (PD) control. Preferably, the control unit 252 is programmed as a proportional-integral-derivative (PID) controller. However, the control unit also may be programmed with PI, PD, or other type of control scheme. The integral term provides a positive feedback to increase the output of the system near the desired temperature. The derivative term looks at the rate of change of the workpiece temperature and adjusts the output based on the rate of change to prevent overshoot.

The control unit 252 provides two output signals to the power source 70 via the control cable 102. The power source 70 receives the two signals and operates in response to the two signals. The first signal is a contact closure signal 262 that energizes contacts in the power source 70 to enable the power source 70 to apply power to the induction heating cable 56. The second signal is a command signal 264 that establishes the percentage of available power for the power source 70 to apply to the induction heating cable 56. The voltage of the command signal 264 is proportional to the amount of available power that is to be applied. The greater the voltage of the command signal 264, the greater the amount of power supplied by the power source. In this embodiment, a variable voltage was used. However, a variable current may also be used to control the amount of power supplied by the power source 70.

Referring generally to FIGS. 6 and 7, the electrical switches that provide signals to the control unit 252 include a run button 266, a hold button 268, and a stop button 270. In addition, a power switch 272 is provided to control the supply of power to the controller 72. The run button 266 directs the control unit 252 to begin operating in accordance with the programming instructions. When closed, the run button 266 couples power through the power switch 272 to the control unit 252. In addition, a first relay 274 and a second relay 276 are energized. When energized, the first relay closes first contacts 278 and the second relay 276 closes second contacts 280. The relays and contacts maintain power coupled to the control unit 252 after the run button 266 is released.

The hold button 268 stops the timing feature of the controller 72 and directs the control unit 252 to maintain the workpiece at the current target temperature. The hold button 268 enables the system 50 to continue operating while new programming instructions are provided to the controller 72. When operated, the hold button 268 opens, removing power from the first relay 274 and opening the first contacts 278. This directs the controller to remain at the current point in the heating cycle so that the heating cycle begins right where it was in the cycle when operation returns to normal. Additionally, the second relay 276 remains energized, maintaining the second contacts 280 closed to allow the power supply to continue to provide power to the induction heating coil 56. The run button 266 is re-operated to redirect the control unit 252 to resume operation in accordance with the programming instructions. When re-operated, the first relay 274 is re-energized and the first contacts 278 are closed. The stop button 270 directs the control unit 252 to stop heating operations. In the illustrated embodiment, a circuit 281 is completed when the stop button 270 is fully depressed. The circuit 281 directs the control unit 252 to be reset to the first segment of the heating cycle.

The I/O unit 254 receives data from the power source 70 and couples it to the control unit 252 and/or the parameter display 256. The data may be a fault condition recognized by the power source 70 or various operating parameters of the power source 70, such as the voltage, current, frequency, and power of the signal being provided by the power source 70 to the flexible inductive heating cable 56. The I/O unit 254 receives the data from the power source 70 via the control cable 102.

In the illustrated embodiment, the I/O unit 254 also receives an input from a flow switch 282. The flow switch 282 is closed when there is adequate cooling flow returning from the flexible inductive heating cable 56. When fluid flow through the flow switch 282 drops below the required flow rate, flow switch 282 opens and the I/O unit 254 provides a signal 284 to the control unit 252, causing the control unit 252 to direct the power source 70 to discontinue supplying power to the induction heating cable 56 or to place the system in a safe condition. For example, when the flow switch 282 indicates a low flow condition, a pump (not shown) in the fluid cooling unit could be directed to operate at a higher speed to correct the low flow condition. Additionally, the flow switch 282 is located downstream, rather than upstream, of the flexible inductive heating cable 56 so that any problems with coolant flow, such as a leak in the flexible inductive heating cable 56, are detected more quickly.

A power source selector switch 286 is provided to enable a user to select the appropriate scale for display of power on the parameter display for the power source coupled to the controller 72. The power selector switch 286 enables a user to thereby set the controller for the specific power source controlled by the controller 72. For example, the controller 72 may be used to control a variety of different powers having the same voltage range corresponding to the percentage output of the power source. Thus, a 5 volt output from a 50 KW power source would represent 25 KW while a 5 volt output from a 20 KW power source would represent only 10 KW. The power source selector switch 286 enables a user to toggle through a selection of power source maximum output powers, 5 KW, 25 KW, 50 KW, etc., corresponding to the maximum output power of the power source 72.

The controller 72 also has a plurality of visual indicators to provide a user with information. One indicator is a heating light 288 to indicate when power source output contacts are closed to enable current to flow from the power source 70 to the induction heating cable 56. Another indicator is a fault light 290 to indicate to a user when a problem exists. The fault light may be lit when there is an actual fault, such as a loss of coolant flow, or when an improper power source 70 condition exists, such as a power or current limit or fault.

Referring generally to FIG. 7, the control unit 252 is programmed from the exterior of the controller 72. In addition, the exterior of the controller 72 has a number of operators and indicators that enable a user to operate the system 50. For example, the control unit 252 has a temperature controller 300 that enables a user to input programming instructions to the control unit 252. The illustrated temperature controller 300 has a digital display 302 that is operable to display programming instructions that may be programmed into the system 50. In the illustrated embodiment, the digital display 302 is operable to display both the actual workpiece temperature 304 and a target temperature 306 that has been programmed into the system 50. The digital display 302 may also display other temperature information, such as the segment type/function and the programmed rate of temperature change. The illustrated temperature controller 300 has a page forward button 308, a scroll button 310, a down button 312, and an up button 314 that are used to program and operate the system 50. To program the control unit 252, the page forward button 308 is operated until a programming list is displayed.

Additionally, the digital recorder 260 has a touch-screen display 322 that is present on the exterior of the controller 72. The illustrated touch-screen display 322 is operable to display temperature information from one or more temperature feedback devices 60. For example, the touch-screen display 322 is operable to visually graph the temperature of the workpiece over time. The touch-screen display 322 may be operable to display system operating parameter information, as well. The touch-screen display 322 is operable to display a number of icons that are activated by touching the touch- screen display 322. The illustrated touch-screen display 322 has a page up icon 324, a page down icon 326, a left icon 328, a right icon 330, an option icon 332, and a root icon 334. The touch-screen display 322 may have additional or alternative icons. The name of the system user who performed the inductive heating operation may be added for display on the touch-screen display 322. Other information, such as a description of the workpiece 52, may also be added for display. Additionally, the illustrated data recorder 260 has a disc drive 336. The disc drive 336 is operable to receive data stored in the data recorder 260 for transfer to a computer system. In addition, or alternatively, to the disc drive 336, the recorder 260 may have the capability for networking, such as a RJ45 network connection, and/or a PCMCIA card.

The power source 70 is operable to detect various power source parameters, such as when a fault condition exists or an operational limit has been reached. When a fault condition is detected by the power source 70, the power source 70 shuts itself down. The system continues to operate when an operational limit is reached. In both case, the power source 70 informs the controller 72 via the control cable 102 when the fault condition exists or the operational limit has been reached. The controller 72, in turn, energizes the fault light 290 on the controller 72 to indicate to an operator that a fault condition exists or that an operational limit has been reached. Preferably, the fault light 290 is larger and has a different color than other lights on the system 50. In addition, the placement of the fault light 290 on the controller 72, rather than the power source 70, increases its visibility to a user. Users are more inclined to look at the controller 72 than the power source 70.

Referring generally to FIG. 8, the power source 70 senses a number of operational parameters and provides limit and fault signals to the controller 72 when operation limits or fault limits are exceeded. In addition, the power source 70 is adapted to provide a visual indication of the specific fault or system limit that has been detected. In the illustrated embodiment, the power source 70 utilizes a series of LED's to provide visual indications to assist a user in performing diagnostic checks of the system.

One of the system parameters sensed is current source current. A current source limit LED 502 is illuminated when an operational limit is reached in the amount of current being supplied by the power source 70. A current source fault LED 504 is illuminated when a fault limit is reached in the amount of current being supplied by the power source 70. The current source fault LED 504 is set to illuminate at a higher current than the current source limit LED 502. Additionally, a signal is sent to the controller 72 to indicate the existence of a fault or limiting condition.

Another system parameter sensed is the frequency of the current flowing from the power source 70. Power source indications include an over-frequency limit LED 506 and an over-frequency fault LED 508. The over-frequency limit LED 506 is illuminated when a high-frequency operational limit is reached in the current supplied by the power source 70. The over-frequency fault LED 508 is illuminated when a high-frequency fault limit is reached in the frequency of the current supplied by the power source 70. The over-frequency fault LED 508 is set to illuminate at a higher frequency than the over-frequency limit LED 506. Additional indications include an under-frequency limit LED 510 and an under-frequency fault LED 512. The under-frequency limit LED 510 is illuminated when a low-frequency operational limit is reached in the current supplied by the power source 70. The under-frequency fault LED 512 is illuminated when a low-frequency fault limit is reached in the frequency of the current supplied by the power source 70. The under-frequency fault LED 512 is set to illuminate at a lower frequency than the under-frequency limit LED 510. Additionally, signals are sent to the controller 72 to indicate the existence of an over or under frequency fault or limiting condition.

Still another system parameter that is sensed is reactive current. A current limit LED 513 is illuminated when an operational limit is reached in the amount of reactive current flowing within the power source 70. A current fault LED 514 is illuminated when a fault limit is reached in the amount of reactive current flowing within the power source 70. The current fault LED 514 is set to illuminate for a higher reactive current than the current limit LED 513. Additionally, signals are sent to the controller 72 to indicate the existence of a reactive current fault or limiting condition.

Additionally, the voltage present in the tank circuit formed by the tank capacitor 96 (See FIG. 3) and the induction heating cable 56 is sensed. A tank voltage limit LED 516 is illuminated when an operational limit is reached in the tank voltage. A tank voltage fault LED 518 is illuminated when a fault limit has been reached in the tank voltage. The tank voltage fault LED 518 is set to illuminate at a higher tank voltage than the tank voltage limit LED 516. Additionally, signals are sent to the controller 72 when a tank voltage fault or limit exists.

The line voltage LED 520 illuminates when the line voltage to the power source deviates sufficiently from the expected voltage. The overtemp LED 522 illuminates when an over temperature condition exists in the power source 70. The load LED 524 illuminates when there is no load or insufficient load is present to couple power to the induction heating cable 56. The ground fault LED 526 illuminates when a ground fault is detected. Fault signals are sent to the controller 72 when the line voltage LED 520, overtemp 522, load LED 524, or ground fault LED 526 is illuminated. Finally, the contactor LED 528 is illuminated when the contactor within the power source 70 is energized by the controller 72.

Figure 9:
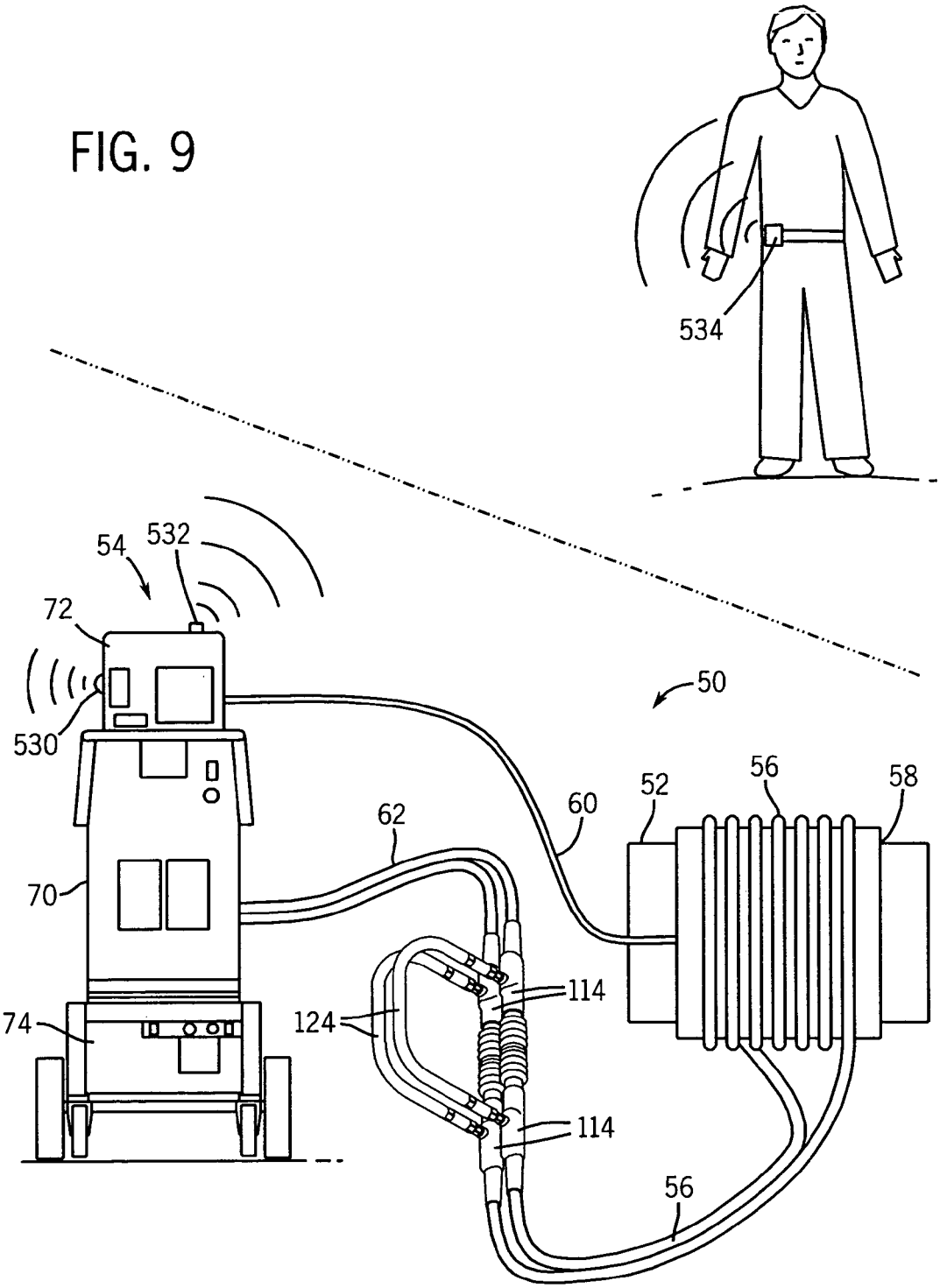
FIG. 9 is an induction heating system having an audible alarm and an electronic communication system, according to an exemplary embodiment of the present technique.

Referring generally to FIG. 9, the system may be adapted with an audible alarm 530, as well. The system 50 may also be adapted with other alarm and indication features. For example, the system 50 may be adapted with a communication circuit 532 to enable the portable induction heating system to communicate electronically with an operator. For example, the communication circuit 532 may be a modem connected to a hard-line telephone connection, a wireless telephone, a radio or any other of a myriad of different possible communication systems. The communication circuit 532 may enable the system to call or page an operator having a wireless phone or pager 534 when there is a problem, such as a loss of cooling flow or a power source fault condition.

It will be understood that the foregoing description is of preferred exemplary embodiments of this invention, and that the invention is not limited to the specific forms shown. For example, many different types of flow switch may be used to provide an indication of the sufficiency, or insufficiency, of cooling fluid flow. In addition, the specific type of alarm or warning light may vary, as well. The warning lights may be LED's or any other device operable to provide illumination. Additionally, the specific criteria for triggering an alarm or warning light may vary. These and other modifications may be made in the design and arrangement of the elements without departing from the scope of the invention as expressed in the appended claims.

What is claimed is:

1. A portable induction heating system, comprising:

a power source;

a fluid cooling unit operable to provide a flow of cooling fluid;

a flexible fluid-cooled induction heating device that is electrically coupleable to the power source and fluid-icly coupleable to the fluid cooling unit;

a system controller operable to control operation of the induction heating system; and a flow switch that is electrically coupled to the system controller and operable to sense the flow of cooling fluid, wherein the system controller controls operation of at least one of the power source and the fluid cooling unit to prevent heat damage to the flexible fluid-cooled induction heating device when the flow of cooling fluid through the flow switch is below a desired flow rate.

2. The system as recited in claim 1, wherein the system controller is operable to control operation of the power source to prevent power from being applied to the flexible fluid-cooled induction heating device when the flow of cooling fluid through the flow switch is below the desired flow rate.

3. The system as recited in claim 1, wherein the system controller is operable to control operation of the fluid cooling unit to increase fluid flow when the flow of cooling fluid through the flow switch is below the desired flow rate.

4. The system as recited in claim 1, wherein the flow switch is located downstream of the induction heating device.

5. The system as recited in claim 1, wherein the controller comprises an indicator to provide an indication when the flow of cooling fluid through the flow switch is below the desired flow rate.

6. The system as recited in claim 5, wherein the indicator is a visual indicator.

7. The system as recited in claim 5, wherein the indicator is an audible indicator.

8. The system as recited in claim 5, comprising a communication circuit operable to contact a user electronically when the flow of cooling fluid through the flow switch decreases below the desired flow rate.

9. The system as recited in claim 1, wherein the flow switch is external to the controller.

10. A method of operating a portable fluid-cooled induction heating system having a portable fluid cooling unit with a supply side and a return side, comprising:

routing a flexible fluid-cooled induction heating apparatus around a work piece;

routing cooling fluid from a portable fluid-cooling unit to the fluid-cooled induction heating apparatus;

routing the cooling fluid from the fluid-cooled induction heating apparatus to a flow sensor operable to sense cooling fluid flow;

providing a desired cooling fluid flow to the fluid-cooled induction heating apparatus; and automatically removing power from the fluid-cooled induction heating apparatus when the flow sensor indicates that cooling fluid flow is less than the desired cooling fluid flow.

11. The method as recited in claim 10, comprising prohibiting power from being applied to the fluid-cooled induction heating apparatus when the flow sensor indicates that cooling fluid flow is less than the desired cooling fluid flow.

12. The method as recited in claim 10, comprising providing a visual indication on a controller operable to control power to the fluid-cooled induction heating apparatus when the flow sensor indicates that cooling fluid flow is less than the desired cooling fluid flow.

13. The method as recited in claim 10, comprising providing an audible alarm when the flow sensor indicates that cooling fluid flow has dropped below the desired cooling fluid flow.

14. The method as recited in claim 10, comprising providing an electronic signal to a communication device when the flow sensor indicates that cooling fluid flow has dropped below the desired cooling fluid flow.

15. A method of assembling a portable induction heating system at a worksite, comprising:

wrapping a flexible fluid-cooled induction heating cable around a work piece;

fluidicly coupling a first end of the flexible fluid-cooled induction heating cable to a supply side of a fluid cooling unit configured for manual transportability;

fluidicly coupling a second end of the flexible fluid-cooled induction heating cable to a flow sensor operable to sense fluid flow therethrough, the flow sensor being electrically coupled to a power source controller operable to control power to the flexible induction heating cable; and fluidicly coupling the flow sensor to the return side of the portable fluid cooling unit.

16. The method as recited in claim 15, comprising wherein the flow sensor is disposed within an enclosure housing the power source controller.

17. A portable induction heating system, comprising:

a power source;

a fluid cooling unit operable to provide a flow of cooling fluid;

a flexible induction heating device that is electrically coupleable to the power source and fluidicly coupleable to the fluid cooling unit;

a wheeled cart adapted for manual transport the fluid cooling unit and the power source to a work piece;

a system controller operable to control operation of the power source; and a flow switch that is electrically coupled to the system controller and operable to sense the flow of cooling fluid, wherein the system controller controls the operation of the power source to prevent power from being applied to the induction heating device when the flow of cooling fluid through the flow switch is below a desired flow rate.

18. The system as recited in claim 17, wherein the system controller removes power from the induction heating device when the flow of cooling fluid through the flow switch drops below the desired flow rate.

19. The system as recited in claim 17, comprising an indicator to provide an indication when the flow of cooling fluid through the flow switch is below the desired flow rate.

20. The system as recited in claim 19, wherein the indicator is disposed on the exterior of the system controller.

21. The system as recited in claim 19, wherein the indicator is a visual indicator.

22. The system as recited in claim 19, wherein the indicator is an audible alarm.

23. The system as recited in claim 19, comprising a communication circuit operable to contact a user electronically when the flow of cooling fluid through the flow switch decreases below the desired flow rate.

24. An induction heating system, comprising:

an induction heating power source;

a flexible fluid-cooled induction heating device electrically coupled to the induction heating power source;

a fluid cooling unit operable to provide a flow of cooling fluid through the fluid-cooled induction heating device;

a communication circuit operable to transmit a wireless alarm signal when an improper operating condition exists in the induction heating power source, or the flow of cooling fluid, or both.

25. The system as recited in claim 24, wherein the wireless alarm signal comprises a cellular phone transmission.

26. The system as recited in claim 24, wherein the wireless alarm signal comprises a radio transmission.

27. The system as recited in claim 24, comprising a flow sensor operable to provide a signal representative of the flow rate of the flow of cooling fluid, wherein the communications circuit transmits an alarm signal when the flow rate of the flow of cooling fluid is below a desired flow rate.

28. The system as recited in claim 27, wherein the flow sensor comprises a flow switch that changes state when the flow rate of cooling fluid flowing through the flow sensor drops below the desired flow rate.

29. The system as recited in claim 27, comprising an audible alarm operable to provide an audible indication when the flow rate of cooling fluid through the flow sensor is below the desired flow rate.

30. The system as recited in claim 27, comprising a visual alarm operable to provide a visible indication when the flow rate of cooling fluid through the flow sensor is below the desired flow rate.

31. An induction heating system, comprising:

an induction heating power source;

a flexible fluid-cooled induction heating device that is electrically coupleable to the induction heating power source;

a fluid cooling unit operable to provide a flow of cooling fluid through the fluid-cooled induction heating device at a desired flow rate; and an alarm system operable to provide an alarm when a signal representative of an improper operating condition in the induction heating power source, or a signal representative of the flow rate of the cooling fluid being below the desired flow rate, or both is received;

wherein the induction heating source and the fluid cooling unit are manually portable.

32. The system as recited in claim 31, wherein the signal representative of an improper operating condition in the induction heating power source comprises a signal representative of current flowing from the induction heating power source exceeding a defined current limit.

33. The system as recited in claim 31, wherein the signal representative of an improper operating condition in the induction heating power source comprises a signal representative of reactive current flowing in the induction heating power source exceeding a defined reactive current limit.

34. The system as recited in claim 31, wherein the signal representative of an improper operating condition in the induction heating power source comprises a signal representative of tank voltage exceeding a defined tank voltage limit.

35. A portable induction heating system, comprising:

an induction heating power source;

a fluid cooling unit operable to provide a flow of cooling fluid;

a flexible fluid-cooled induction heating device that is electrically coupleable to the power source and fluidicly coupleable to the fluid cooling unit, wherein the induction heating power source and the fluid cooling unit are configured for manual transportation;

a system controller operable to control operation of the induction heating system; and a flow switch that is electrically coupled to the system controller and operable to sense cooling fluid flow rate;

wherein the system controller is operable to control operation of the fluid cooling unit to increase the cooling fluid flow rate when the cooling fluid flow rate is below a desired cooling fluid flow rate.

* * * * *